US009777983B2

(12) United States Patent
Porat

(10) Patent No.: US 9,777,983 B2
(45) Date of Patent: Oct. 3, 2017

(54) INTEGRATED HANDGUN GRIP AND RAIL

(71) Applicant: Recover, LLC, Los Angeles, CA (US)

(72) Inventor: Tamir Porat, Tel Aviv (IL)

(73) Assignee: Recover, LLC, Los Angeles, CA (US)

( * ) Notice: Subject to any disclaimer, the term of this patent is extended or adjusted under 35 U.S.C. 154(b) by 0 days.

(21) Appl. No.: 15/034,590

(22) PCT Filed: Nov. 12, 2014

(86) PCT No.: PCT/US2014/065146
§ 371 (c)(1),
(2) Date: May 5, 2016

(87) PCT Pub. No.: WO2015/073492
PCT Pub. Date: May 21, 2015

(65) Prior Publication Data

US 2016/0282082 A1 Sep. 29, 2016

Related U.S. Application Data

(60) Provisional application No. 62/038,448, filed on Aug. 18, 2014, provisional application No. 61/940,448, filed on Feb. 16, 2014, provisional application No. 61/903,509, filed on Nov. 13, 2013.

(51) Int. Cl.
*F41C 23/00* (2006.01)
*F41C 23/10* (2006.01)
*F41G 11/00* (2006.01)

(52) U.S. Cl.
CPC ..... *F41C 23/10* (2013.01); *F41G 11/003* (2013.01)

(58) Field of Classification Search
CPC ..... F41C 23/10; F41G 11/003
USPC ..... 42/71.02
See application file for complete search history.

(56) References Cited

U.S. PATENT DOCUMENTS 3,685,194 A * 8/1972 Coon ..... F41C 23/12 42/72
4,936,036 A 6/1990 Sniezak et al.
5,107,612 A * 4/1992 Bechtel ..... F41G 11/003 42/115
5,166,459 A 11/1992 Stahle
5,584,137 A * 12/1996 Teetzel ..... F41A 9/62 362/114

(Continued)

FOREIGN PATENT DOCUMENTS

CN 202432921 U 9/2012
WO 2011008306 A1 1/2011

OTHER PUBLICATIONS

International Search Report and Written Opinion for PCT/US2014/065146 mailed Feb. 11, 2015.

(Continued)

*Primary Examiner* — Michelle R Clement
(74) *Attorney, Agent, or Firm* — Thomas B. Ryan, Patent Agent; Harter Secrest & Emery LLP

(57) ABSTRACT

An integrated grip and rail adapter for a handgun includes two side panels having both grip sections that are adapted to form at least portions of the handgun grip and receiver sections that are adapted to extend from the grip sections along the receiver frame of the handgun beyond a trigger guard and beneath a barrel of the handgun. A mounting rail for mounting accessories beneath the barrel of the handgun is formed in the two receiver sections.

5 Claims, 10 Drawing Sheets

(56) References Cited

U.S. PATENT DOCUMENTS

| | | | | |
|---|---|---|---|---|
| 5,621,997 | A | 4/1997 | Pearce | |
| 5,930,935 | A * | 8/1999 | Griffin | F41C 27/06 42/105 |
| 6,112,962 | A | 9/2000 | Matthews | |
| 6,267,279 | B1 | 7/2001 | Matthews | |
| 6,385,893 | B1 * | 5/2002 | Cheng | F41G 1/35 42/124 |
| 6,393,752 | B1 * | 5/2002 | Oliver | F41G 1/35 362/110 |
| 6,658,781 | B1 | 12/2003 | Bowen | |
| 6,705,038 | B2 * | 3/2004 | Davenport | F41G 11/004 42/127 |
| 6,732,891 | B2 | 5/2004 | Locklear, III | |
| 6,802,148 | B1 | 10/2004 | Danas | |
| 7,194,836 | B1 * | 3/2007 | Urban | F41C 27/22 42/106 |
| 7,395,627 | B2 * | 7/2008 | La France | F41G 11/003 362/110 |
| 7,578,090 | B1 * | 8/2009 | Romaszka | F41G 11/003 42/85 |
| 7,743,547 | B2 | 6/2010 | Houde-Walter | |
| 7,805,876 | B1 | 10/2010 | Danielson | |
| 8,215,525 | B2 | 7/2012 | Rassias | |
| 8,235,263 | B1 | 8/2012 | Yeates et al. | |
| 8,631,602 | B2 * | 1/2014 | Chupp | F41C 27/00 42/71.02 |
| 8,720,755 | B2 | 5/2014 | Gregory et al. | |
| D728,729 | S * | 5/2015 | Geissele | D22/109 |
| 9,470,480 | B2 * | 10/2016 | Kirchhoff | F41G 11/001 |
| 2005/0115142 | A1 * | 6/2005 | Kim | F41C 27/00 42/146 |
| 2006/0010751 | A1 | 1/2006 | Shear et al. | |
| 2006/0150467 | A1 | 7/2006 | Poulin et al. | |
| 2007/0025101 | A1 | 2/2007 | Lawless | |
| 2007/0256347 | A1 | 11/2007 | Fitzpatrick et al. | |
| 2009/0282718 | A1 | 11/2009 | Bartley | |
| 2011/0131859 | A1 * | 6/2011 | Lawson | F41C 27/00 42/90 |
| 2011/0167704 | A1 | 7/2011 | Chupp | |
| 2011/0185617 | A1 | 8/2011 | Brixius | |
| 2012/0131829 | A1 | 5/2012 | Fistikchi et al. | |
| 2013/0067789 | A1 | 3/2013 | Moore et al. | |
| 2013/0212923 | A1 | 8/2013 | Schneider et al. | |
| 2014/0033593 | A1 | 2/2014 | Moore, Jr. | |
| 2014/0209645 | A1 | 7/2014 | Gregory et al. | |

OTHER PUBLICATIONS

Written Opinion of International Preliminary Examining Authority for PCT/US2014/065146 mailed Sep. 1, 2015.

Jones. 'Recover Tactical CC3 Grip and Rail System Review'. 248 Shooter. Jul. 22, 2013—(Jul. 22, 2013). [Retrieved on Jan. 13, 2015). Retrieved from the internet: Y cURL: http://248shooter.com/index.php/rocover-tactical-cc3-grip-and-rail-system-review/> As Published With Incorrect Date.

Horman. 'Gear Guide: Best 1911 Grips on the Market. Guns & Ammo'. Sep. 19, 2013 (Sep. 19, 2013). [Retrieved on Jan. 14, 2015]. Retrieved from the internet: <URL: http://www.gunsandammo.com/gunsmithing/gear-guide-best-1911-grips-on-the-market/ >.

Loomis, 'Insight Tech Gear MRDS Tactical Sight With Aimtech 1911 Grip Scope Mount', Oct. 22, 2010, [Retrieved on Sep. 17, 2016 from the internet: <http://ezine.m1911.org/showthread.php?60-Insight-MRDS-Mini-Red-Dot-Sight-and-Aimtech-1911-Grip-Scope-Mount-review>.

Uselton Arms, 'New Lightweight 1911 Pistol—Explosively Bonded Metals', Jan. 13, 2013, [Retrieved on Sep. 17, 2016 from the internet: <http://www.useltonarms.com/New_Lightweight_1911_Pistol_-_Explosively_Bonded_Metals/>.

Jones. 'Recover Tactical CC3 Grip and Rail System Review'. 248 Shooter. Jul. 29, 2014—(Jul. 29, 2014). [Retrieved on Jun. 10, 2015. Retrieved from the internet: Y cURL: http://248shooter.com/index.php/rocover-tactical-cc3-grip-and-rail-system-review-2/> As Published With Correct Date.

* cited by examiner

INTEGRATED HANDGUN GRIP AND RAIL

TECHNICAL FIELD

The invention relates to accessory mounts and grips for handguns, including integrated grips and mounting rails as upgraded parts for handguns, particularly handguns that lack convenient attachment points for accessories.

BACKGROUND OF THE INVENTION

Many handguns are manufactured with integrated accessory mounts including rails located along barrels to accommodate accessories that enhance the capabilities of handgun users. Such accessories include sights, laser pointers, and illuminators for aiding the targeting of the handguns. The grip and balance of handguns is also recognized as being of importance to the safe and steady grasp of handguns and to avoiding fatigue and accidents, especially under stressful conditions.

Many handguns, including pistols and revolvers, are still manufactured or remain in use that lack rails or other desired accessory mounts. Various retrofit devices are available that clamp rails or accessories directly to handgun barrels or to trigger guards, often resulting in ungainly combinations subject to shock and misalignment and interfering with holstering.

SUMMARY OF THE INVENTION

The invention as presented in one or more embodiments provides an integrated grip and rail adapter as an attachment to a handgun.

Various embodiments can be arranged to replace or supplement conventional handgun grips with an ergonomically designed grip and rail adapter that integrates a mounting rail with a structure enveloping the lower profile of the handgun including portions of the handgun's receiver and grip extension. For example, the grip and rail adapter can be formed by two mating side panels encasing the lower profile of the handgun. Each side panel includes a grip section, which replaces the original grip panels of the handgun, and a receiver section that extends from a respective grip section and mates with the receiver section of the other side panel beneath the handgun barrel. The mounting rail is supported from both side panels along a common length the receiver sections beyond the handgun's trigger guard. The mounting rail can take the form of a Picatinny rail, a Weaver rail, or other types of tactical or receiver rails.

Preferably, the grip sections also envelop a front strap of the handgun's grip frame (i.e., structural support for the grip or handle) to provide a more integrated gripping surface and can also envelop or abut a rear strap of the handgun's grip frame, integrating either or both a fore grip and a hind grip into an ergonomically designed gripping structure. To provide additional support and functionality, the side panels can also include respective trigger guard sections that wrap around the handgun's trigger guard, leaving the trigger exposed. The trigger guard sections of the respective side panels provide an additional connection between the grip and receiver sections of each side panel. Thus, the receiver sections, which are otherwise connected directly to the grip sections, can also be connected indirectly to the grip sections through the trigger guard sections. The trigger guard sections can also provide a front abutment surface to provide a stop for accessories mounted along the rail. All three sections, i.e., the grip sections, the receiver sections, and the trigger guard sections of the side panels, can include appropriate apertures or cutouts to expose necessary access points on the handgun including the magazine release, take down lever, slide catch, or decocking lever.

The receiver sections of the two side panels are preferably fastened together in mechanical/frictional engagement with each other and in proximate contact or engagement with the handgun's receiver frame (i.e., structural support for the pistol's action and barrel), such as by screwing or bolting the receiver sections together. The grip sections are preferably separately fastened to the grip frame using the same threaded holes in the grip frame as the original grip panels that are replaced. In a preferred embodiment, the front strap portions of the grip sections, the trigger guard sections, and the portions of the receiver sections forming the mounting rail mate directly with each other to provide the effect of a single integrated grip and rail adapter that reforms the lower profile of the handgun. Thus, the integrated grip and rail adapter can provide an uninterrupted lower profile for the safe handling and secure holstering of the handgun.

While primarily intended for attaching mounting rails to handguns to accommodate rail-mounted accessories, the integrated grip and rail adapter can be arranged to mount accessories in other ways. For example, the receiver sections of the side panels can be adapted, e.g., define a cavity there between, to mount a laser pointer or other accessory whose mounting would otherwise require a redesign of the handgun or a special purpose adapter.

The side panels of the integrated grip and rail adapter can also be formed with at least one handgun retention element as a part of a holster retention system to prevent inadvertent or unauthorized removal of the handgun from a holster. For example, the at least one handgun retention element can be formed in at least one of the first and second receiver sections. The retention elements can be formed as recesses, such as notches or grooves, or as protrusions, such as a lugs or pins, designed to releasably interlock with corresponding features of a holster.

The integrated grip and rail adapter can also be formed as a single body, where the two side panels are merely opposite sides of the same body. In place of a seam where the two separate side panels of the earlier described versions mate together, the side panels on opposite sides of the same body merge together without any necessary distinction as to where one side panel ends and the other begins. The grip sections replace the original grip panels of the handgun and exploit the same threaded connections for attaching the single-body integrated grip and rail adapter to the handgun. Friction or mechanical locking, e.g., snap fit engagements or clamping mechanisms, can be used to further secure the receiver sections to the handgun barrel.

The side panels are preferably made of a durable, lightweight, plastic or composite material capable of providing surfaces amenable to both hand-gripping and mounting handgun accessories.

BRIEF DESCRIPTION OF THE DRAWING FIGURES

DETAILED DESCRIPTION OF THE INVENTION

Figure 1:
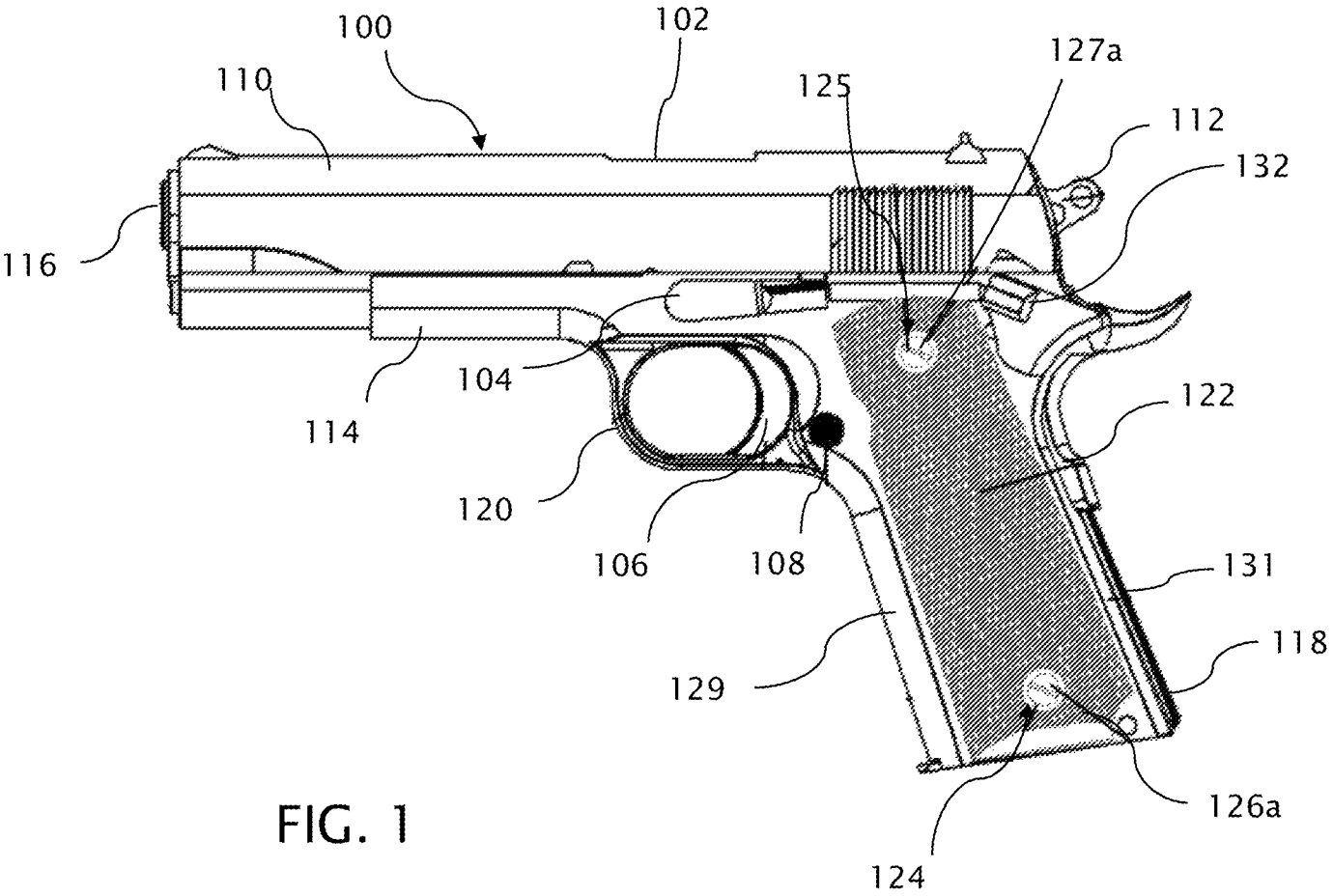
FIG. 1 is a side view of a conventional pistol handgun, which is suitable for use with one or more versions of the integrated grip and rail adapter described for this the invention.

A pistol 100 is depicted in FIG. 1 in the general form of a COLT 1911 as an example of a handgun that can be modified and adapted in accordance with the purposes of this invention. The COLT 1911, which was first introduced in the year 1911, is a single-action, semi-automatic, magazine-fed, recoil-operated pistol. Many millions of units of this model and many similar models are in use today. Similar types of pistols are produced by Wilson, Les Baer, Nighthawk, STI, Kimber, Sig Sauer and S&W.

Pistols, such as the illustrated COLT 1911, as well as revolvers, contain a number of exterior moving or movable parts requiring clearance or access to preserve their normal operation. For example, such parts on the illustrated pistol 100 include a slide 110, an ejection port 102, a slide stop 104, a trigger 106, a magazine catch 108, a magazine catch lock (not shown as it is on the pistol's opposite side), and a hammer 112. The movable parts, which also include a barrel 116, are mounted on a receiver frame 114, which in the illustrated pistol 100 and most others is a part of an overall frame that includes a grip frame 118 as an integral extension. Removable grip panels 122 are attached to the grip frame 118 at attachment points 124 and 125 through the use of reusable fasteners such as grip screws 126*a* and 127*a* (opposite side grip screws 126*b* and 127*b* not shown) together with any bushings or washers (not shown) for aligning or reinforcing the connections.

Figure 2:
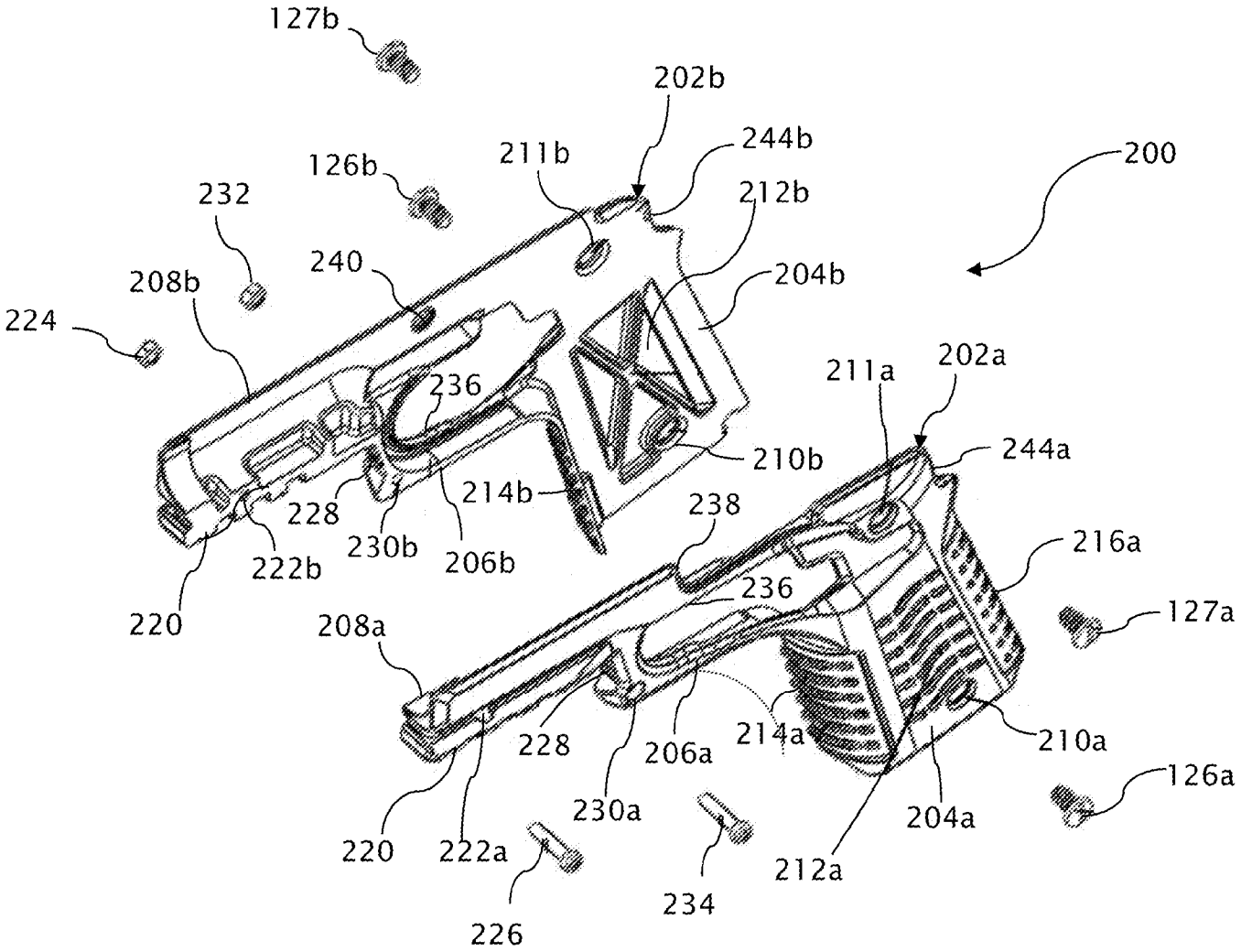
FIG. 2 is an exploded perspective view of the two side panels that can be combined to form a version of integrated grip and rail adapter suitable for the handgun of FIG. 1.
Figure 2A:
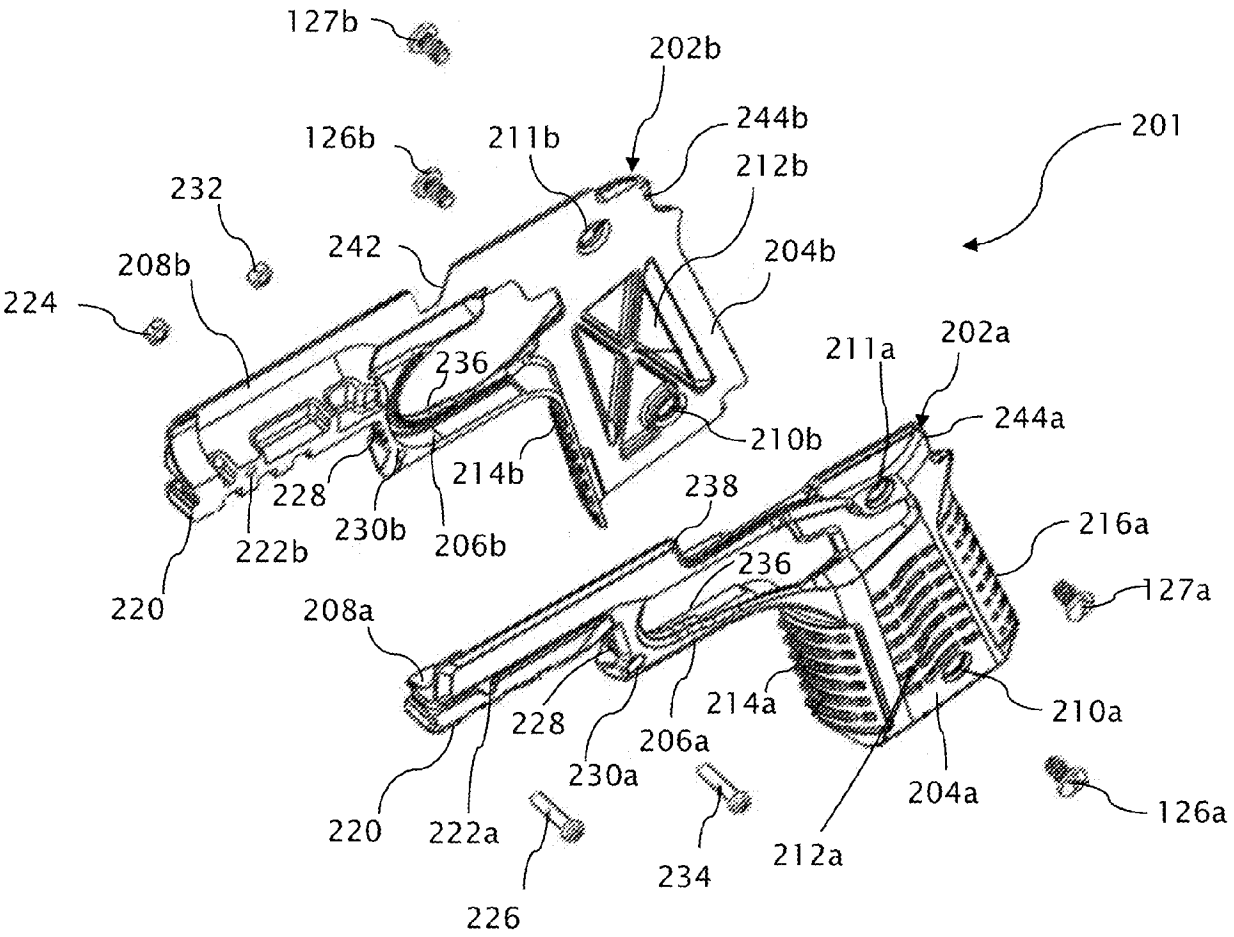
FIG. 2A is an exploded perspective view of a slightly modified version of the two side panels of FIG. 2.
Figure 3:
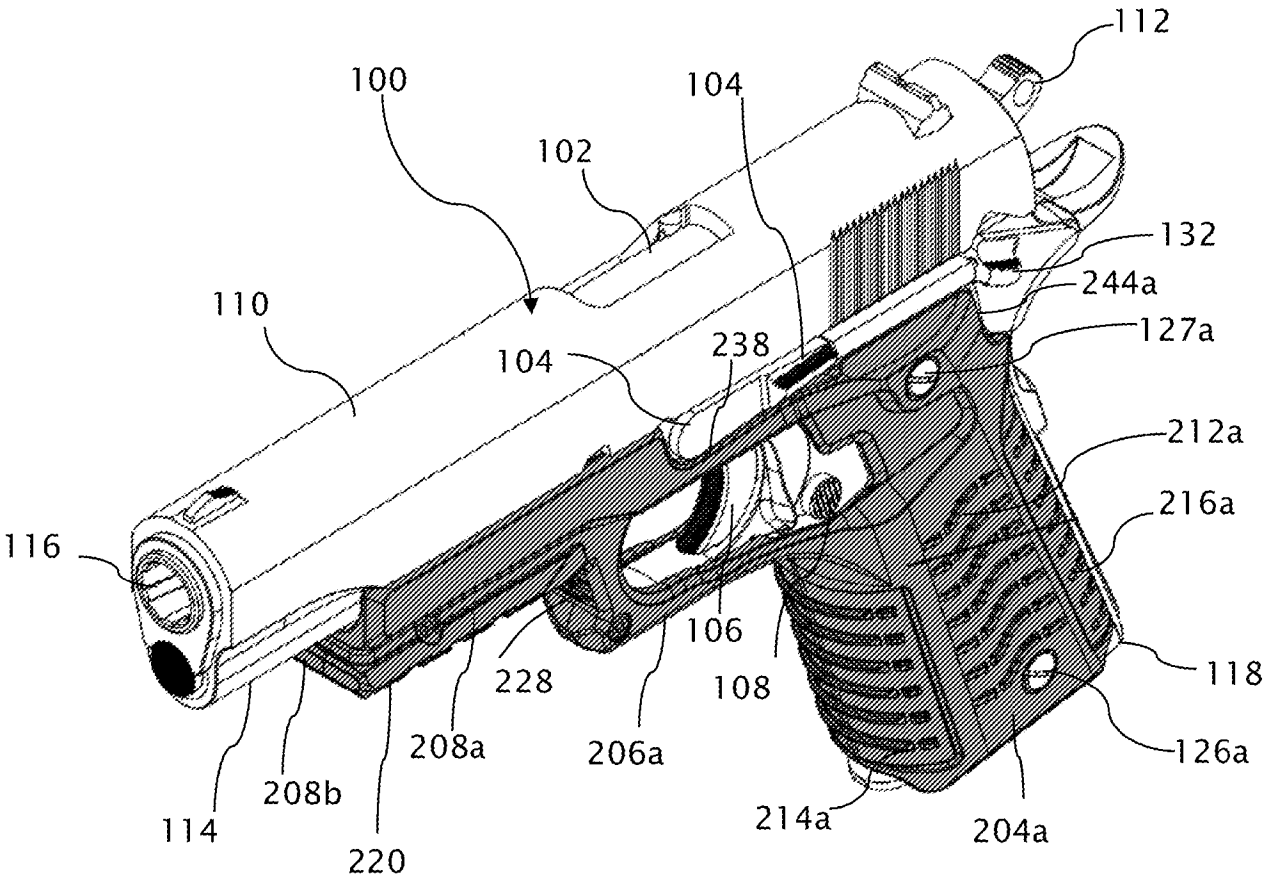
FIG. 3 is a perspective view of the integrated grip and rail adapter of either FIG. 2 or 2A attached to the handgun of FIG. 1.

An integrated grip and rail adapter of this invention applicable to a pistol, such as the pistol 100 is presented in FIGS. 2, 2A, and 3 with the integrated grip and rail adapter 201 of FIG. 2A being a slightly modified version of the integrated grip and rail adapter 200 of FIG. 2. The elements in common between the two integrated grip and rail adapters 200 and 201 share the same reference characters. The integrated grip and rail adapters 200 and 201 each include two side panels 202*a* and 202*b*, each comprising three sections, namely, grip sections 204*a* and 204*b*, trigger guard sections 206*a* and 206*b*, and receiver sections 208*a* and 208*b*.

As replacements for the grip panels 122 of the pistol 100, grip sections 204*a* and 204*b* are configured to attach to the grip attachment points 124 and 125 (shown in FIG. 1) through respective opposite-side lower attachment holes 210*a* and 210*b* and opposite-side upper attachment holes 211*a* and 211*b*. The grip panels 122 (FIG. 1) are detached from a pistol 100 by unscrewing and removing the grip screws 126*a* and 127*a* (FIG. 1), as well as opposite side grip screws 126*b* and 127*b*, from the grip frame 118. Once the grip panels 122 have been removed, the side panels 202*a* and 202*b*, as shown in FIG. 3, can be placed over the corresponding sides of the pistol 100 such that the lower and upper attachment holes 210*a* and 211*a* of the side panel 202*a*, as well as the lower and upper attachment holes 210*b* and 211*b* of the side panel 202*b*, are positioned over the attachment points 124 and 125 (FIG. 1). Fasteners, preferably the same grip screws 126*a*, 127*a* and 126*b*, 127*b* (as well as any desired bushings or washers), attach the side panels 202*a* and 202*b* to the grip frame 118. Other types of removable fasteners can also be used as well as more permanent attachment mechanisms, if so desired, including screws, pins, bolts, adhesives, clasps and rivets. In addition, the grip sections 204*a* and 204*b* can be connected to each other. For example, the grip sections 204*a* and 204*b* can be connected to each other through or around the grip frame 118 or at points of contact with each other.

The grip sections 204*a* and 204*b* include side grip portions 212*a* and 212*b* to replace the grip panels 122 and, as shown in FIGS. 2, 2A, and 3, and also include fore grip portions 214*a* and 214*b* that envelop at least part of a front strap portion 129 (FIG. 1) of the grip frame 118. The fore grip portions 214*a* and 214*b* contact each other to provide an interconnection between the two side panels 202*a* and 202*b* and together wrap around the front strap portion 129 of the grip frame 118 to provide an improved fore grip that is fully integrated with the side grip portions 212*a* and 212*b* of the grip sections 204*a* and 204*b*. Contact between the two fore grip portions 214*a* and 214*b* can be centered within the front strap portion 129 of the grip frame 118 or can be offset so that more or even all of the front strap portion 129 is covered by one or the other of the grip sections 204*a* or 204*b*. In addition, the interface between the two contacting fore grip portions 214*a* and 214*b* could take a serpentine, zigzag, or other interlocking form for constraining relative motion along the interface. As shown in FIGS. 2 and 2A, the grip sections 204*a* and 204*b* also include hind grip portions 216*a* and 216*b* that abut a back strap portion 131 of the grip frame 118 to further enhance and balance the overall grip of the pistol 100. Alternatively, the hind grip portions 216*a* and 216*b* can be extended into contact with each other to wrap around the back strap portion 131 of the grip frame 118 to provide a hind grip that can be adapted to improve the overall grip and/or better accommodate recoil during the firing of the pistol 100. Similar to the fore grip portions 214*a* and 214*b*, contact between the hind grip portions 216*a* and 216*b* can be centered or offset with respect to the back strap portion 131 of the grip frame 118 and the interface between the hind grip portions 216*a* and 216*b* can be shaped to form an interlock. Surfaces of the resulting fore grip formed by the fore grip portions 214*a* and 214*b* and/or surfaces of the resulting hind grip formed by the hind grip portions 216*a* and 216*b* can be smooth, textured, undulated, or otherwise patterned to accommodate different gripping preferences.

Although the grip panels 122 of the pistol 100 are preferably removed and replaced by the grip sections 204*a* and 204*b*, the grip sections 204*a* and 204*b* could also be designed to fit over the existing grip panels 122 before being attached to the grip frame 118. Although different ways of attaching the side panels 202*a* and 202*b* could be used with the existing grip panels 122 in place, the attachment holes 210*a*, 211*a* and 210*b*, 211*b* could still be aligned with the attachment points 124 and 125 on the receiver frame 114, and the original screws 126*a*, 127*a* and 126*b*, 127*b* or longer screws as well as bushings could be used to secure both the grip panels 122 and the grip sections 204*a* and 204*b* to the grip frame 118.

The receiver sections 208*a* and 208*b* of the side panels 202*a* and 202*b* extend from and are supported by the respective grip sections 204*a* and 204*b* in a direction along the barrel 116 and are configured to fit beneath the slide 110 to avoid interfering with the firing action of the pistol 100. As shown in FIGS. 2, 2A, and 3, both receiver sections 208*a* and 208*b* contribute to forming a mounting rail 220, which can take a conventional form such as a Picatinny rail or a Weaver rail, or adopt other forms of tactical or receiver rails for accommodating desired types of accessories having appropriately mating mounting elements. Common among such accessories already known for such rail mountings are sights, laser pointers, and illuminators. Other known accessories include bipods for fixed sighting, backup components, auxiliary grips, bayonets, and adapter rails.

In the overall example depicted in FIGS. 2, 2A, and 3, both of the receiver sections 208*a* and 208*b* contribute to forming the mounting rail 220. Contact between the two receiver sections 208*a* and 208*b* is shown along the middle of the mounting rail 220 but the contributions of the two receiver sections 208*a* and 208*b* to the mounting rail 220 could also be unevenly or differently distributed along or across the mounting rail 220. Similar to the interfaces between the grip sections 204*a* and 204*b*, the interface between the two receiver sections 208*a* and 208*b* can be offset from the middle of the mounting rail 220 and can take the form of an interlock to constrain motion along the interface.

In addition to attachment holes 210*a*, 211*a* and 210*b*, 211*b* through which the grip sections 204*a* and 204*b* of the side panels 202*a* and 202*b* are secured to the grip frame 118, the two receiver sections 208*a* and 208*b* of the side panels 202*a* and 202*b* can be clamped to the receiver frame 114 or at least to each other through the interface between the receiver sections 208*a* and 208*b*. For example, as shown in FIGS. 2, 2A, and 3, holes 222*a* and 222*b* are formed through the two receiver sections 208*a* and 208*b* in a pedestal portion of the mounting rail 220 and a nut 224 and bolt 226 combination draws the two receiver sections 208*a* and 208*b* together against a recoil spring housing of the receiver frame 114. Other types of fasteners or more permanent attachment mechanisms could also be used as described above to secure the two receiver sections 208*a* and 208*b* to each other and/or the receiver frame 114.

The trigger guard sections 206*a* and 206*b* of the side panels 202*a* and 202*b*, which follow the general profile of the trigger guard 120, each provide a second connection between the grip sections 204*a* and 204*b* and the receiver sections 208*a* and 208*b* of the side panels 202*a* and 202*b*. The second connection provides additional support for the mounting rail 220. The trigger guard sections 206*a* and 206*b* can also provide a front abutment surface 228 to provide a stop for accessories mounted along the mounting rail 220.

Additional ergonomic improvements and options can also be provided by the trigger guard sections 206*a* and 206*b*, such as more comfortable and secure locations for resting the user's trigger finger when not on the trigger 106. Together, the grip sections 204*a* and 204*b*, the trigger guard sections 206*a* and 206*b*, and the receiver sections 208*a* and 208*b* of the side panels 202*a* and 202*b* provide safe and secure handling locations apart from the moving parts of the pistol 100 and can be integrated with each other in design and material to provide improved gripping and handling surfaces. The re-formed lower profile of the pistol 100 provided by the side panels 202*a* and 202*b* can also be adapted for the safe handling and secure holstering of the pistol 100 such as by providing gripping surfaces adapted to particular uses, environments, or gripping styles or by providing features that can be adapted to or adapted in conjunction with holstering design and performance considerations. In addition, the side panels 202*a* and 202*b*, as formed from a durable, light-weight, plastic or composite material, can provide thermal isolation from the higher temperatures generated within the barrel 116 and firing mechanism as well as from higher rates of thermal transfer through the exposed metal components, including the receiver frame 114 and/or grip frame 118, of the pistol 100.

Similar to the two receiver sections 208*a* and 208*b*, the trigger guard sections 206*a* and 206*b* of the side panels 202*a* and 202*b* can be clamped to each other and the receiver frame 114 across an interface between the trigger guard sections 206*a* and 206*b*. The interface can extend along the middle of the trigger guard 120, be displaced to either side of the trigger guard 120, or provide an interlocking structure as described for the other sections of the side panels 202*a* and 202*b*.

Similar to the clamping mechanism between the two receiver sections 208*a* and 208*b*, holes 230*a* and 230*b* are formed through the two trigger guard sections 206*a* and 206*b*, and a nut 232 and bolt 234 combination draws the two trigger guard sections 208*a* and 208*b* together against the trigger guard 120. Other types of fasteners or more permanent attachment mechanisms could also be used as described above to secure the two trigger guard sections 208*a* and 208*b* to each other and/or the trigger guard 120. Preferably, the clamping or other attachment mechanism extends in front of the trigger guard 120 adjacent to the mounting rail 220 to provide additional support for securing the two receiver sections 208*a* and 208*b* together as well.

In addition to forming a cavity 236 matching the interior outline of the trigger guard 120 to preserve desired access to the trigger 106, the trigger guard sections 206*a* and 206*b*, together with the grip sections 204*a* and 204*b*, and the receiver sections 208*a* and 208*b*, are configured to preserve access to other movable parts of the pistol 100. For example, the cavity 236 exposing the trigger 106 is expanded and shaped to provide access to the magazine catch 108 and its lock (not shown) on the other side of the pistol 100. As shown in FIG. 2, a cutout (or notch) 238 is formed in the receiver section 208*a* and an aperture 240 is formed in the receiver section 208*b* providing both accesses and clearance to preserve the normal operation the slide stop 104. As shown in the slightly revised version FIG. 2A, the aperture 240 is replaced by a cutout 242 formed in the receiver section 208*b* also for providing access to the opposite end of the slide stop 104. In the versions of both FIGS. 2 and 2A, additional cutouts 244*a* and 244*b* are formed in the grip sections 204*a* and 204*b* to provide clearance for operating a manual safety 132.

The side panels 202*a* and 202*b* can be fashioned, particularly by molding, using various materials suitable for forming both a grip and a mounting rail and for supporting the mounting rail. Preferably, the material is a lightweight material such that the attached side panels 202*a* and 202*b* do not significantly increase the weight of the modified pistol as shown in FIG. 3 with respect to the pistol with its original grip panels 122. For example, the side panels 202*a* and 202*b* can be fashioned from an engineering plastic, a high-grade polymer composite, or plastics based on polyphthalamide and other polyamides, nylon, fiberglass, etc. Alternatively, the different sections 204*a*, 204*b*, 206*a*, 206*b*, and 208*a*, 208*b* of the side panels 202*a* and 202*b* or even portions of the different sections can be made from different materials, such as one or more lightweight metals including titanium, aluminum, or combinations of such metals.

Figure 4:
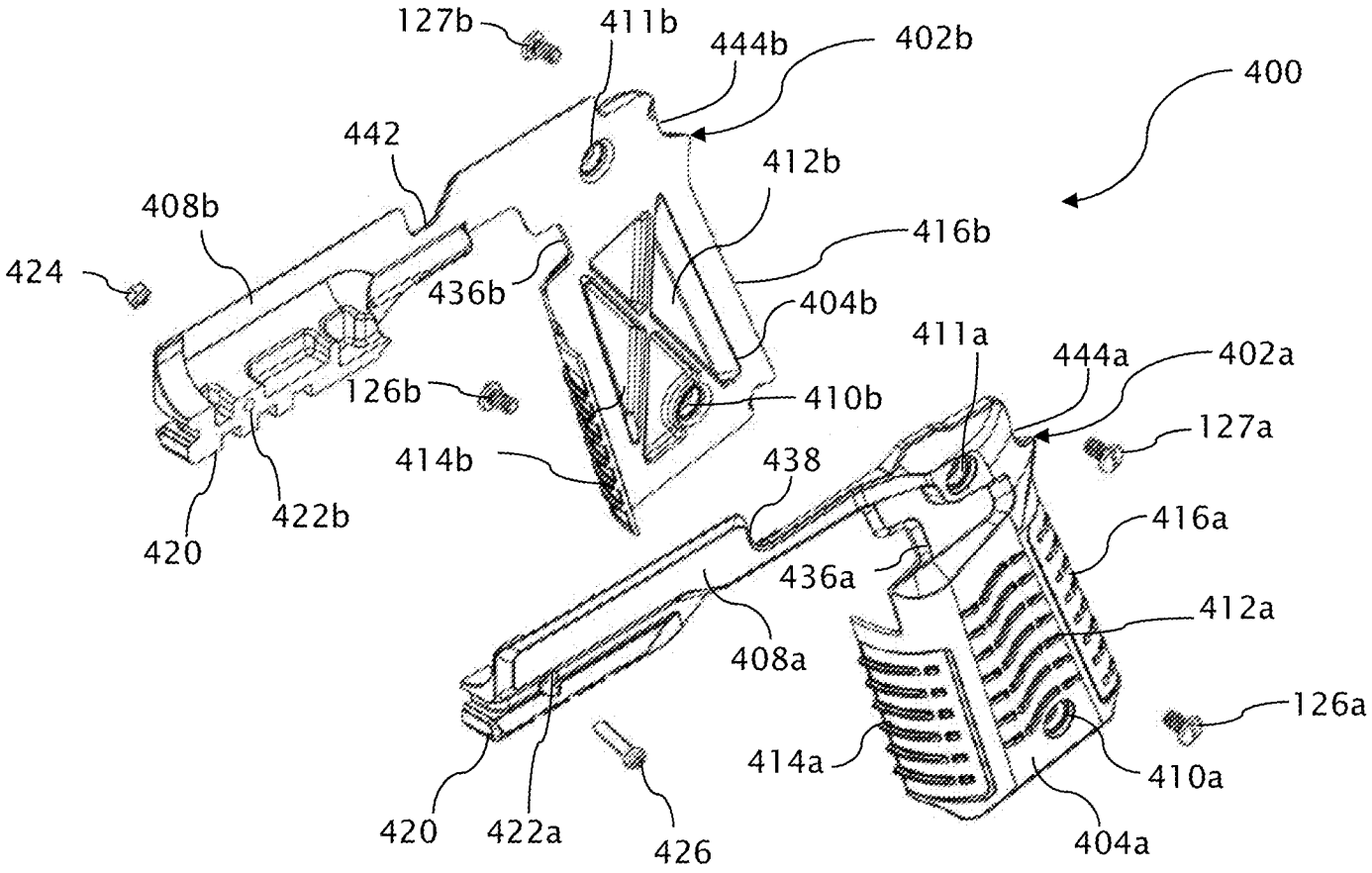
FIG. 4 is an exploded perspective view of two alternative side panels without trigger guard sections that can be combined to form another version of integrated grip and rail adapter suitable for the handgun of FIG. 1.

An alternative embodiment of the integrated grip and rail adapter is shown in FIG. 4 with reference characters designating corresponding elements indexed by two-hundred. For example, the embodiment includes two side panels 402*a* and 402*b* including grip sections 404*a* and 404*b* as replacements for the grip panels 122 of the pistol 100 and receiver sections 408*a* and 408*b* as extended structures for appending a mounting rail 420 to a forward end of the receiver frame 114 beneath the barrel 116 and a recoil spring housing of the receiver frame 114.

Both of the receiver sections 408*a* and 408*b* are shown in FIG. 4 as contributing to forming the mounting rail 420. As discussed in the preceding embodiment, contact between the two receiver sections 408*a* and 408*b* can occur along the middle of the mounting rail 420 as shown or can be unevenly or differently distributed along or across the mounting rail 420. For example, the interface between the two receiver sections 408*a* and 408*b* can be offset from the middle of the mounting rail 420 and can take the form of an interlock to constrain motion along the interface.

Similar to the preceding embodiments, the two receiver sections 408*a* and 408*b* of the side panels 402*a* and 402*b* can be clamped to the receiver frame 114 or at least to each other through the interface between the receiver sections 408*a* and 408*b*. For example, holes 422*a* and 422*b* are formed through the two receiver sections 408*a* and 408*b* in a pedestal portion of the mounting rail 420 and a nut 424 and bolt 426 combination draws the two receiver sections 408*a* and 408*b* together against a recoil spring housing of the receiver frame 114. Additional or alternative clamping or attachment mechanisms can be used as described above.

Also similar to the preceding embodiments, the grip sections 404*a* and 404*b* can be separately attached to the grip frame 118 and can be joined to each other along one or more interfaces associated, for example, with fore grip portions 414*a*, 414*b* and a hind grip portions 416*a*, 416*b*. Once the grip panels 122 have been removed and the side panels 402*a* and 402*b* have been placed over the corresponding sides of the pistol 100, the same grip screws 126*a*, 127*a* and 126*b*, 127*b* (as well as any desired bushings or washers) that originally secured the grip panels 122 can be used to attach the side panels 402*a* and 402*b* through respective attachment holes 410*a*, 411*a* and 410*b*, 411*b* to the grip frame 118. As explained, other types of removable fasteners can also be used as well as more permanent attachment mechanisms. In addition, the grip sections 404*a* and 404*b* can be connected to each other through or around the grip frame 118 or at points of contact with each other.

The fore grip portions 414*a* and 414*b* contact each other to provide a direct interconnection between the two side panels 402*a* and 402*b* and together wrap around the front strap portion 129 of the grip frame 118 to provide an improved fore grip that is fully integrated with the side grip portions 412*a* and 412*b* of the grip sections 404*a* and 404*b*. Contact between the two fore grip portions 414*a* and 414*b* can be varied as described for the preceding embodiments. The hind grip portions 416*a* and 416*b* can abut the back strap portion 131 of the grip frame 118 or can be extended into contact with each other to wrap around the back strap portion 131 of the grip frame 118. In keeping with the preceding embodiments, similar relative advantages and forms of contact can be defined.

The embodiment of FIG. 4 differs from the preceding embodiments of FIGS. 2 and 2A primarily by the absence of trigger guard sections, leaving the receiver sections 408*a* and 408*b* cantilevered solely from the grip sections 404*a* and 404*b*. The height of the receiver sections 408*a* and 408*b* remains limited by the slide 110 and various cutouts and apertures, e.g., cutouts 436*a*, 436*b*, 438, 442, 444*a*, and 444*b*, are formed in both the grip sections 404*a* and 404*b* and the receiver sections 408*a* and 408*b* to preserve the desired access and clearance for the moving and movable parts of the pistol 100.

Figure 5:
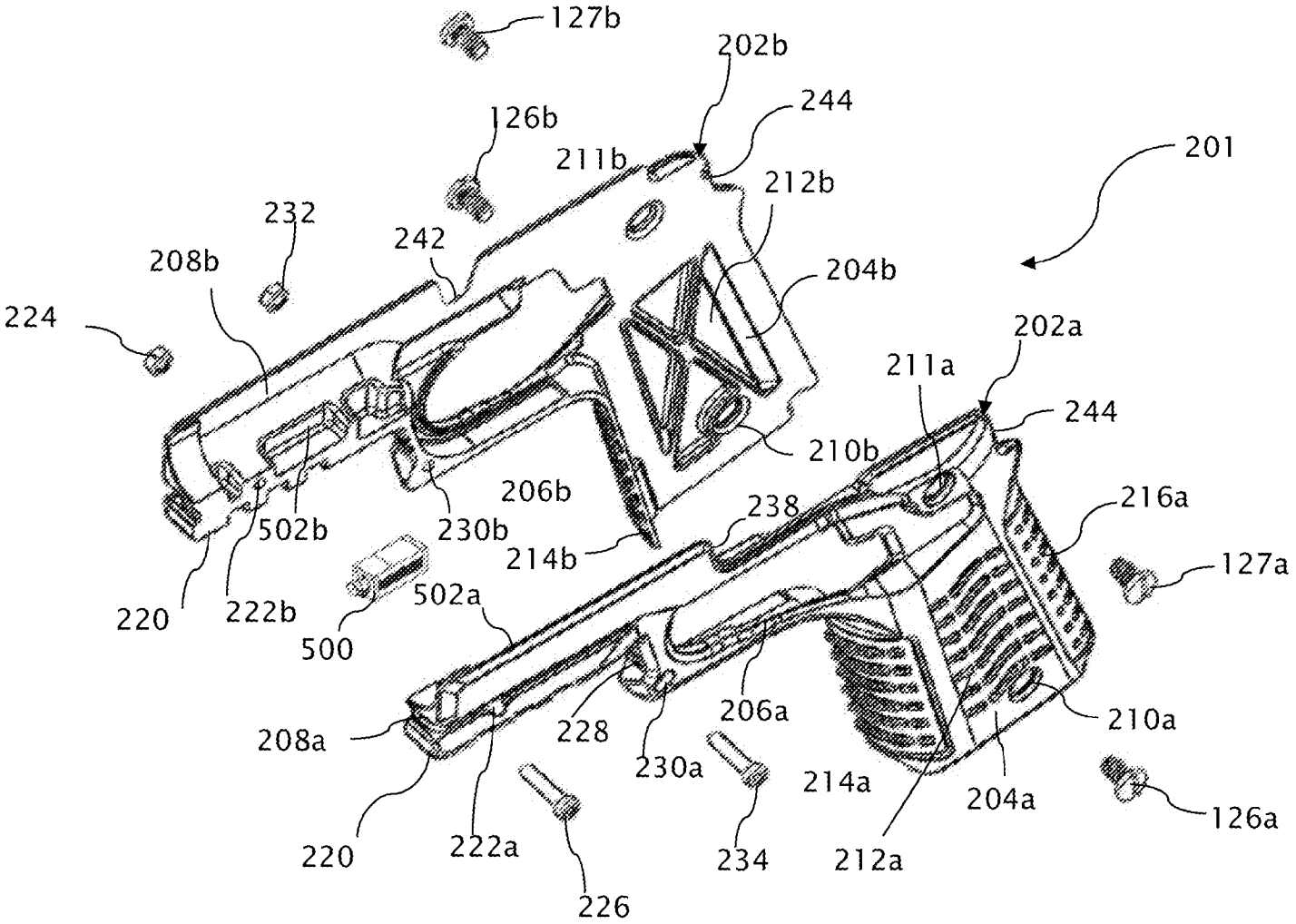
FIG. 5 is an exploded perspective view of two more alternative side panels adapted for an additional purpose that can be combined to form another version of integrated grip and rail adapter suitable for the handgun of FIG. 1.

FIG. 5 depicts an exploded perspective view of an embodiment of the invention based most closely on the embodiment of FIG. 2A but equally applicable to the embodiments of FIGS. 2 and 4, as well as the embodiments discussed infra. The reference characters of FIG. 2A are applied to corresponding elements. Recesses 502*a* and 502*b* in the receiver sections 208*a* and 208*b* just above the mounting rail 220 are used to mount a handgun accessory depicted as a laser pointer 500. Although only the recesses 502*b* in the receiver section 208*b* is clearly visible due to the perspective view of FIG. 5, the recess 502*a* is a similarly formed in the receiver section 208*a* in alignment with the recess 502*b*. When the two side panels 202*a* and 202*b* are brought together and secured to the opposite sides of the pistol 100, the two recesses 502*a* and 502*b* form a common cavity within which the laser pointer 500 or other handgun accessory is securely imbedded. Although not shown, a channel or other passageway is preferably formed in one or both receiver sections 208*a* and 208*b* to allow passage of a pointing beam substantially parallel with the barrel 116 for illuminating spots on targets. A switch and/or separate power supply (also not shown) can be mounted in and electrically connected to the laser pointer 500 between the two side panels 202*a* and 202*b* in any one or more of their respective sections. For example, a toggle switch could be mounted in the trigger guard sections 206*a* and 206*b*. The common cavity formed by the recesses 502*a* and 502*b* could also be used for other purposes such as a battery compartment for powering accessories mounted on the mounting rail 220 or as a housing for a switch or sensor that improves the functionality of the pistol 100. The two side panels 202*a* and 202*b*, which largely cover the exposed non-moving portions of the pistol 100, including the pistol grip, provide additional opportunities for embedding or attaching accessories as well as for modifying the lower profile of the pistol 100 for other purposes such as holstering.

Figure 6:
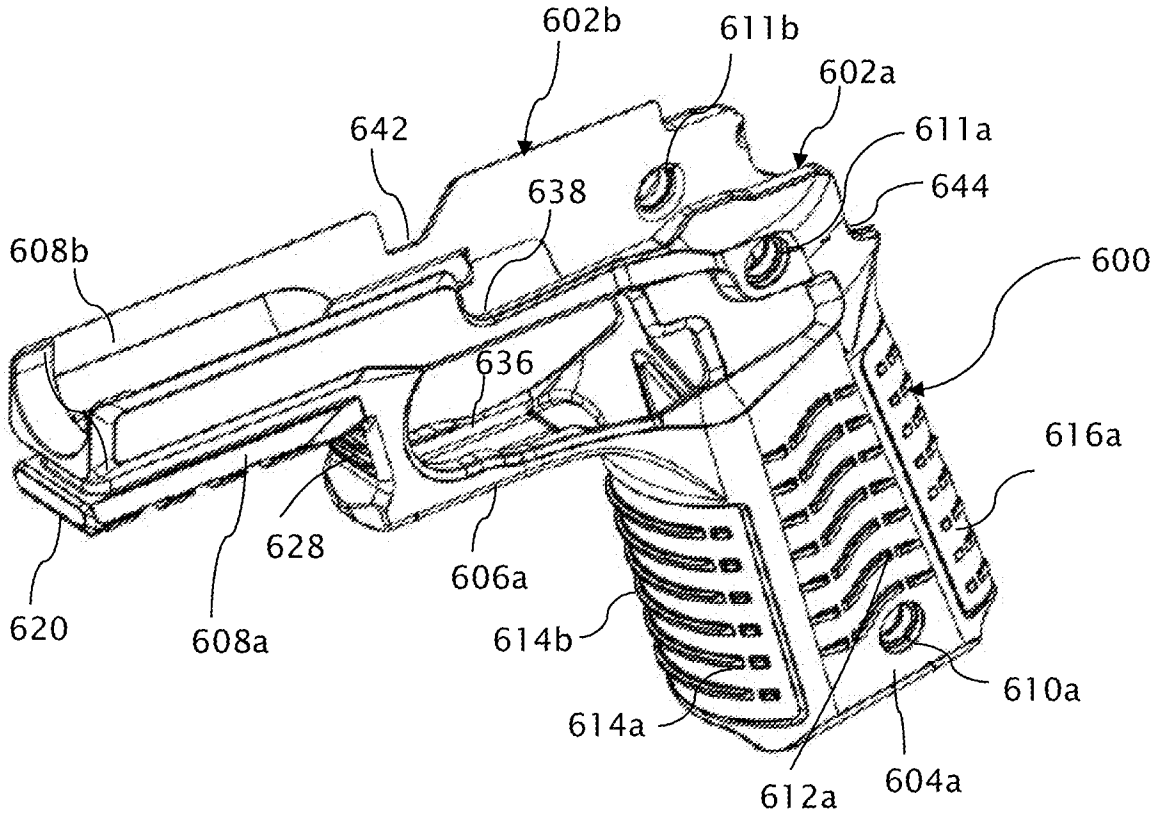
FIG. 6 is a perspective view of two side panels including trigger guard sections merged into a single body.
Figure 7:
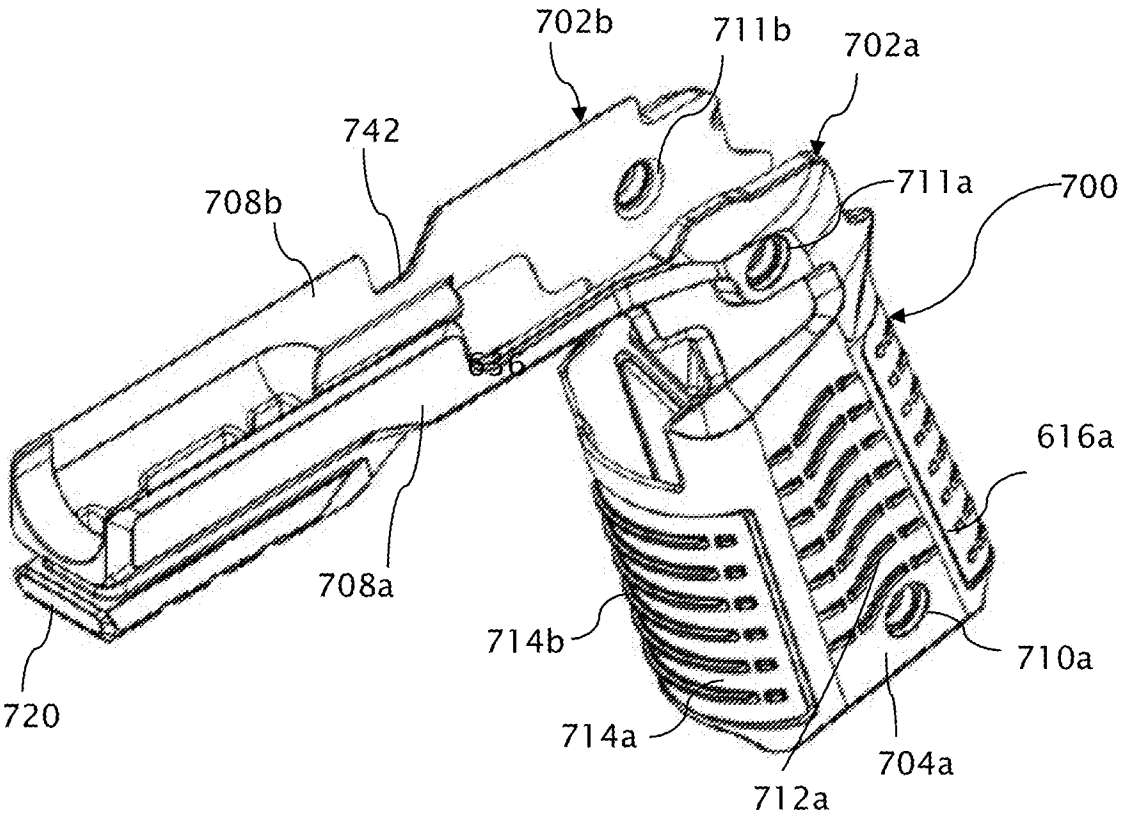
FIG. 7 is a perspective view of the two side panels not including trigger guard sections merged into a single body.

FIGS. 6 and 7 depict embodiments in which the two side panels of the preceding embodiments are formed in unitary bodies. In FIG. 6, two side panels 602*a* and 602*b* are virtually identical to the side panels 202*a* and 202*b* of FIG. 2A but are permanently joined or formed together in a single unitary body 600. Reference characters designating corresponding elements from FIG. 2A are indexed by four-hundred. In FIG. 7, two side panels 702*a* and 702*b* are virtually identical to the side panels 402*a* and 402*b* of FIG. 4 but are permanently joined or formed together in a single unitary body 700. Reference characters designating corresponding elements from FIG. 4 are indexed by three-hundred. Either of the unitary bodies 600 and 700 can be formed by separately forming (e.g., molding) the respective side panels 602*a*, 602*b* or 702*a*, 702*b* and permanently fixing (e.g., gluing or welding) the side panels 602*a*, 602*b* or

702*a*, 702*b* together or by originally forming (e.g., molding) the side panels 602*a*, 602*b* or 702*a*, 702*b* as the respective unitary bodies 600 or 700.

Although the lower profile including the grip of the pistol 100 must be inserted into the spaces between the side panels 602*a*, 602*b* or 702*a*, 702*b* for purposes of assembly, the unitary bodies 600 and 700 can be attached to the pistol grip frame 118 in a fashion similar to the individual pairs of side panels 202*a*, 202*b* and 402*a*, 402*b*. That is, the grip panels 122 are preferably removed and the attachment holes 610*a*, 611*a*, 610*b*, 611*b* or 710*a*, 711*a*, 710*b*, 711*b* are positioned over attachment points 124 and 125 (FIG. 1). The original screws 126*a*, 127*a* and 126*b*, 127*b* or longer screws as well as bushings can be used to secure the side panels 602*a*, 602*b* or 702*a*, 702*b* to the pistol grip frame 118. Other temporary or more permanent attachment mechanisms as mentioned above can be used to secure the unitary bodies 600 or 700 to the pistol 100. The individual features of the separate side panels 202*a*, 202*b* and 402*a*, 402*b* can be enjoyed by their unitary counterpart side panels 602*a*, 602*b* and 702*a*, 702*b* except, of course, with respect to their respective interfaces, which are only relevant to certain manufacturing options for the unitary bodies.

Figure 8A:
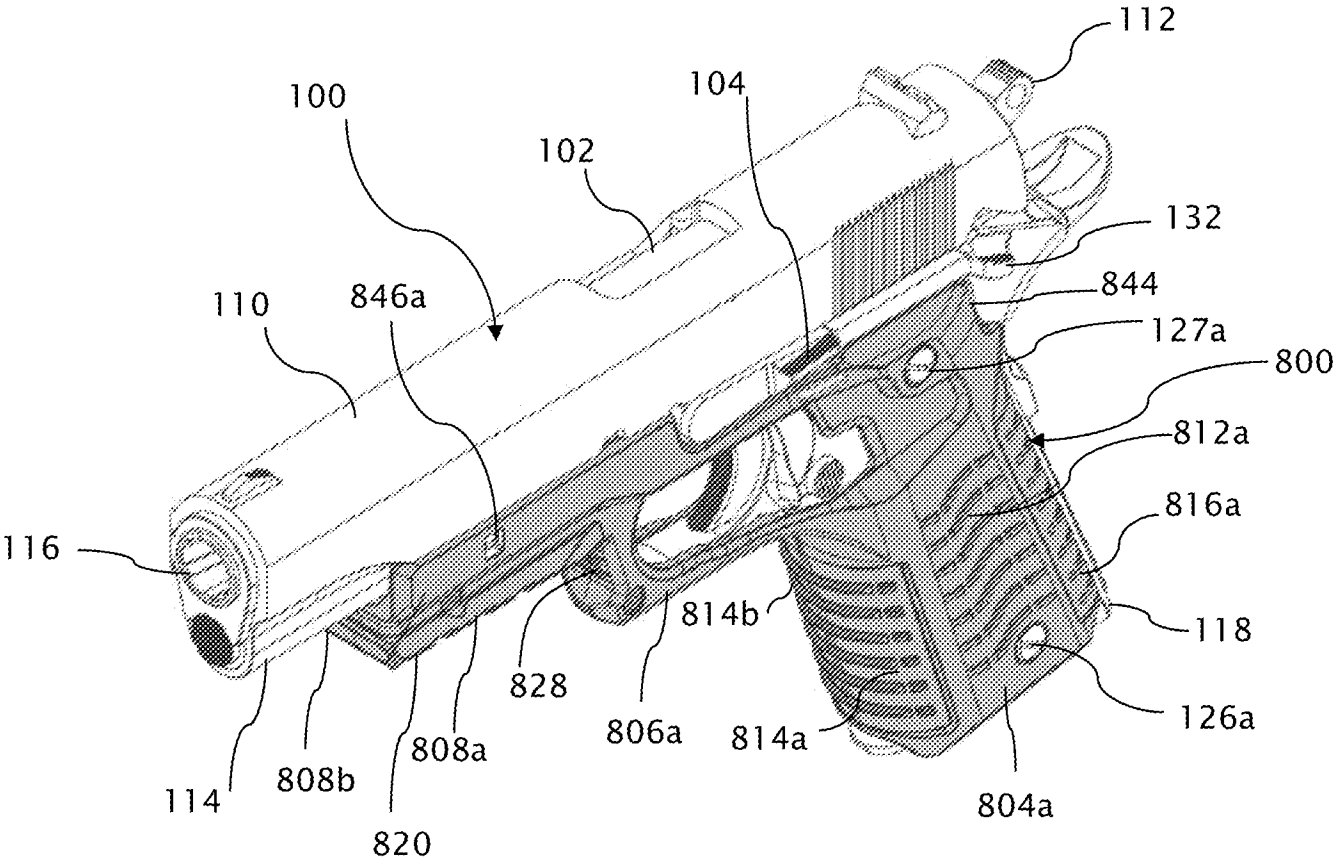
FIGS. 8A and 8B are opposite side perspective views of another version of the integrated grip and rail adapter attached to the handgun of FIG. 1 incorporating a handgun retention element for securing the handgun in a holster.
Figure 8B:
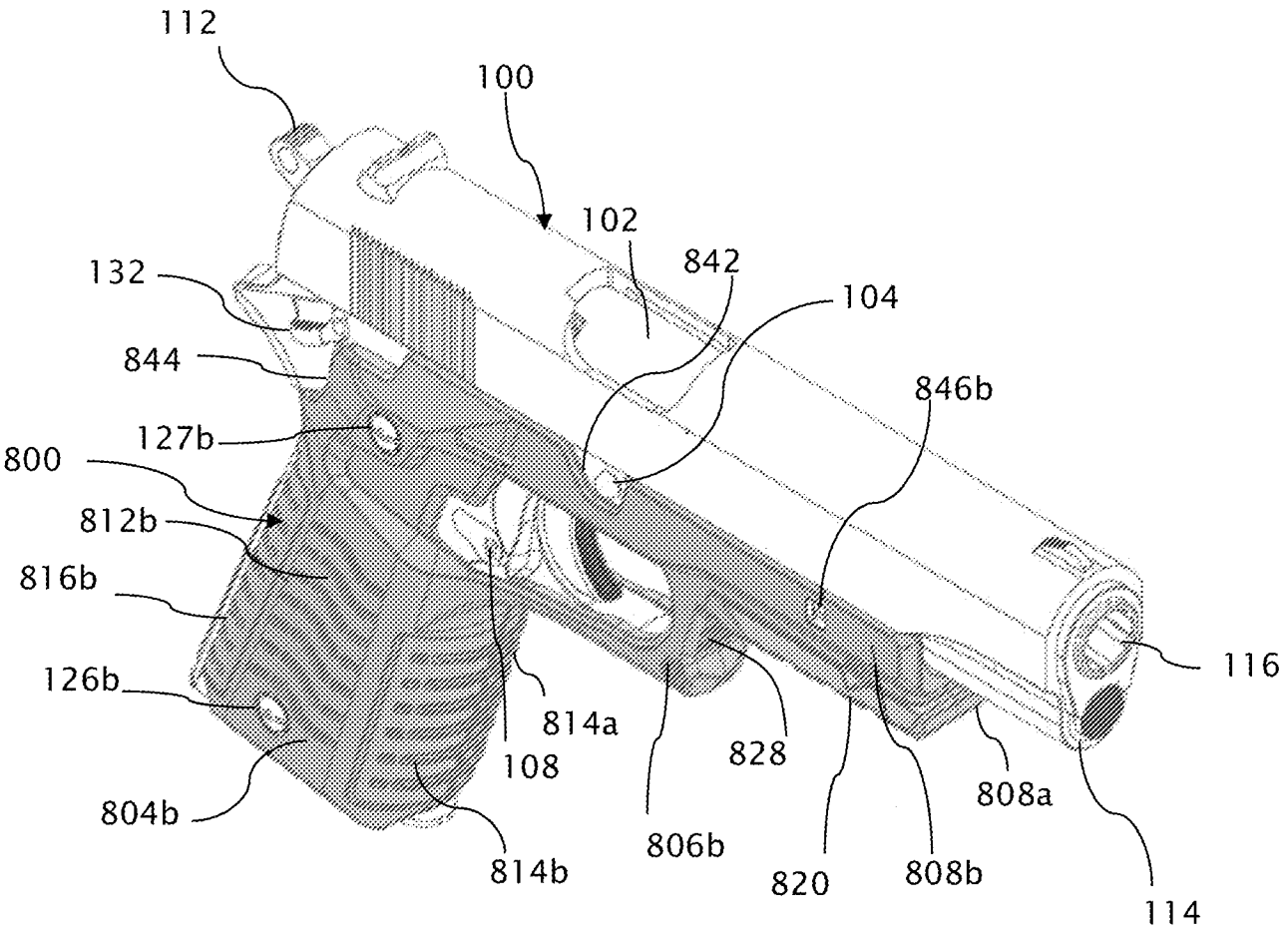

FIGS. 8A and 8B depict in opposite side perspective views a version of the invention with an integrated grip and rail adapter 800 based most closely on the version of FIG. 2A attached to the handgun 100 of FIG. 1. Elements in common with the version of FIG. 2A share reference characters indexed by six-hundred. The version of FIGS. 8A and 8B is distinguished by the addition of a handgun retention elements 846*a* and 846*b*, which are formed in respective receiver sections 808*a* and 808*b* of the side panels 802*a* and 802*b*, as a part of a holster retention system to prevent inadvertent or unauthorized removal of the pistol 100 from a holster (not shown).

The retention elements 846*a* and 846*b*, which are depicted as notches in the receiver sections 808*a* and 808*b*, can take a variety of forms including other recess shapes such as grooves, or take the form of protrusions, such as lugs or pins, designed to releasably interlock with corresponding features of a holster. Conventionally, such holster retention systems engage with a trigger guard, such as the trigger guard 120, when fully holstered, but the side panels 802*a* and 802*b* provide additional opportunities for retaining pistols, such as the pistol 100, in holsters.

Preferably, the retention elements 846*a* and 846*b* are located along one or both of the receiver sections 808*a* and 808*b* in positions convenient for locating a mating or otherwise engaging catch on the holster that can be released by deliberate action of the pistol user but otherwise retains the pistol 100 in the holster as a protection against the inadvertent or unauthorized removal of the pistol 100 from the holster. Since the retention elements 846*a* and 846*b* can take a variety of forms and be positioned as desired along the receiver sections 808*a* and 808*b* without modifying receiver frame 114, improved holster retention devices are made possible balancing issues of security with ready access while also allowing holsters to be optimized for other purposes unconstrained by the requirement to provide a retention device for engaging a trigger guard.

Alternatively, the retention elements 846*a* and 846*b* can be located elsewhere on the side panels 802*a* and 802*b*, including on one or both of the trigger guard sections 806*a* and 806*b*, to provide for an improved or otherwise altered pistol retention device within a holster unconstrained by the original features of a trigger guard, such as the trigger guard 120. For example, different types of releasable interlocks can be used by adjusting the shape of the retention elements 846*a* and 846*b* that are formed in the side panels 802*a* and 802*b* for releasably engaging a catch formed in the holster.

Although the embodiments, particularly for purposes of ready comparison have been drawn with respect to a single handgun design, the principles of the invention are readily adaptable to other types of handguns, including both pistols and revolvers, that lack mounting rails including various handguns made by manufacturers such as Browning and Highpower.

The particular embodiments and descriptions are illustrative of many ways that will be apparent to those of skill in the art for carrying out the invention. Such changes include similar adaptions to the form and functions of other handguns and to carrying out particular objectives or preferences as taught possible or otherwise evident from the teachings of the invention.

The invention claimed is:

1. An integrated grip and rail adapter for a handgun comprising:

a first side panel including a first grip section and a first receiver section for mounting along one side of a handgun with the first grip section adapted to form a portion of a grip on the one side of a handgun and the first receiver section adapted to extend from the first grip section along a receiver frame on the one side of the handgun beyond a trigger guard and beneath a barrel of the handgun, a second side panel including a second grip section and a second receiver section for mounting along an opposite side of the handgun with the second grip section adapted to form a portion of the grip on the opposite side of a handgun and the second receiver section adapted to extend from the second grip section along the receiver frame on the opposite side of the handgun beyond the trigger guard and beneath the barrel, a mounting rail for mounting accessories in alignment with the barrel of the handgun arranged for being supported beyond the trigger guard and beneath the barrel by the first and second receiver sections, and the first and second grip sections respectively supporting the first and second receiver sections extending from the first and second grip sections, so that the mounting rail is supported by the first and second grip sections, wherein a recess is formed in each of the first and second receiver sections to form a common cavity above the mounting rail for mounting a handgun accessory.

2. The integrated grip and rail adapter of claim 1 in which the common cavity is arranged for mounting a laser pointer beneath the barrel of the handgun.

3. An integrated grip and rail adapter for a handgun comprising:

a first side panel including a first grip section and a first receiver section for mounting along one side of a handgun with the first grip section adapted to form a portion of a grip on the one side of a handgun and the first receiver section adapted to extend from the first grip section along a receiver frame on the one side of the handgun beyond a trigger guard and beneath a barrel of the handgun, a second side panel including a second grip section and a second receiver section for mounting along an opposite side of the handgun with the second grip section adapted to form a portion of the grip on the opposite side of a handgun and the second receiver section adapted to extend from the second grip section along the receiver frame on the opposite side of the handgun beyond the trigger guard and beneath the barrel, and a mounting rail for mounting accessories beneath the barrel of the handgun including first and second portions formed as respective parts of the first and second receiver sections that are adapted to be attached together along a common interface for securing both the first and second portions of the mounting rail and the first and second side panels to each other, wherein the first side panel includes a first trigger guard section extending from the first grip section to the first receiver section, and the second side panel includes a second trigger guard section extending from the second grip section to the second receiver section, and the first and second trigger guard sections are adapted for to be attached together along a common interface for further securing the first and second side panels to each other.

4. An integrated grip and rail adapter for a handgun comprising:

a first side panel including a first grip section and a first receiver section for mounting along one side of a handgun with the first grip section adapted to form a portion of a grip on the one side of a handgun and the first receiver section adapted to extend from the first grip section along a receiver frame on the one side of the handgun beyond a trigger guard and beneath a barrel of the handgun, a second side panel including a second grip section and a second receiver section for mounting along an opposite side of the handgun with the second grip section adapted to form a portion of the grip on the opposite side of a handgun and the second receiver section adapted to extend from the second grip section along the receiver frame on the opposite side of the handgun beyond the trigger guard and beneath the barrel, and a mounting rail for mounting accessories beneath the barrel of the handgun including first and second portions formed as respective parts of the first and second receiver sections that are adapted to be attached together along a common interface for securing both the first and second portions of the mounting rail and the first and second side panels to each other, wherein a recess is formed in each of the first and second receiver sections to form a common cavity above the mounting rail for mounting a handgun accessory.

5. The integrated grip and rail adapter of claim 4 in which the common cavity is arranged for mounting a laser pointer beneath the barrel of the handgun.

* * * * *